US008171762B2

(12) United States Patent
Hsiao et al.

(10) Patent No.: US 8,171,762 B2
(45) Date of Patent: May 8, 2012

(54) ANTI-THEFT DEVICE FOR THE SECURITY

(75) Inventors: Chen-Nan Hsiao, Chung-Ho (TW); Chun-Sheng Wu, Chung-Ho (TW)

(73) Assignee: Sinox Co., Ltd, Chung-Ho, Taipei County (TW)

( * ) Notice: Subject to any disclaimer, the term of this patent is extended or adjusted under 35 U.S.C. 154(b) by 430 days.

(21) Appl. No.: 12/410,122

(22) Filed: Mar. 24, 2009

(65) Prior Publication Data

US 2009/0235699 A1 Sep. 24, 2009

Related U.S. Application Data

(60) Provisional application No. 61/038,952, filed on Mar. 24, 2008.

(51) Int. Cl.
*E05B 69/00* (2006.01)

(52) U.S. Cl. ..... 70/58; 70/14; 248/551

(58) Field of Classification Search ..... 70/14, 57, 70/58; 248/551–553
See application file for complete search history.

(56) References Cited

U.S. PATENT DOCUMENTS 1,932,132 A * 10/1933 Cherry ..... 439/306
4,313,319 A * 2/1982 Haus et al. ..... 70/34
4,391,110 A * 7/1983 Nielsen, Jr. ..... 70/34
4,617,810 A * 10/1986 Fish et al. ..... 70/14
5,154,440 A * 10/1992 Dolan et al. ..... 280/507
5,622,064 A * 4/1997 Gluskoter et al. ..... 70/14
6,125,669 A * 10/2000 McDaid et al. ..... 70/58
6,216,499 B1 * 4/2001 Ronberg et al. ..... 70/58
6,973,809 B2 * 12/2005 Chang ..... 70/58
7,204,106 B2 * 4/2007 Merrem et al. ..... 70/14
7,243,514 B2 * 7/2007 Frantz ..... 70/58
7,441,426 B2 * 10/2008 Avganim ..... 70/58
7,549,308 B2 * 6/2009 Avganim ..... 70/58
7,836,551 B2 * 11/2010 Hung et al. ..... 16/319
2004/0261473 A1 * 12/2004 Avganim ..... 70/58
2005/0028571 A1 * 2/2005 Merrem et al. ..... 70/58
2006/0086160 A1 * 4/2006 Marszalek et al. ..... 70/58
2007/0074547 A1 * 4/2007 Wu ..... 70/58
2008/0163654 A1 * 7/2008 Avganim ..... 70/58
2010/0326144 A1 * 12/2010 Foster et al. ..... 70/58
2011/0133050 A1 * 6/2011 Eisenberger et al. ..... 248/551

* cited by examiner

*Primary Examiner* — Suzanne Barrett
(74) *Attorney, Agent, or Firm* — Muncy, Geissler, Olds & Lowe, PLLC

(57) ABSTRACT

An anti-theft device for a portable device is disclosed, wherein the portable device includes an aperture. The anti-theft device includes a coupler, an engaging/disengaging device, and a localizer. The localizer couples the engaging/disengaging device with an immovable object. The coupler includes a bridge portion and a leg, wherein the bridge portion and the leg are disposed on two different sides of the portable device. The engaging/disengaging device engages with the aperture of the portable device and also couples with the coupler to clamp the portable device.

19 Claims, 15 Drawing Sheets

ANTI-THEFT DEVICE FOR THE SECURITY

CROSS REFERENCE TO RELATED APPLICATIONS

This application claims priority of U.S. Provisional Application No. 61/038,952 filed on Mar. 24, 2008 under 35 U.S.C. §119(e), the entire contents of which are hereby incorporated by reference.

BACKGROUND OF THE INVENTION

1. Field of the Invention

This invention relates to an anti-theft device for a portable electronic device, and more specifically, to a laptop computer having an anti-theft device.

2. Description of the Prior Art

Portable electronic devices become more and more popular and now play an important role in our daily life. Portable electronic devices such as laptop computers, digital cameras, and portable music players are typically small and expensive. Thus, when left unattended, the portable electronic devices can be easily stolen. Accordingly, security devices are developed in order to prevent theft of such portable electronic devices.

Typically, a security device with an engaging mechanism and a corresponding security aperture are used to prevent theft of the portable electronic device, wherein the security aperture is formed on the portable electronic device. The engaging mechanism can be selectively coupled with the security aperture. The security device is fixed to a relatively immovable object such as a table. Alternatively, the security device can include a cable to be fastened to the immovable object. In this way, the security device couples the portable electronic device to the relatively immovable object and thus prevents theft of the portable electronic device.

As for laptop computers, the security device can only prevent the device from being taken away. However, the security device cannot stop a person from opening and using the laptop computer. Furthermore, interfaces such as USB receptacles are also exposed outside, and thus data may be accessed through these interfaces by unauthorized users. Thus, there is a need for a security device which can be used to immobilize the portable electronic device and to prevent unauthorized persons from using the portable electronic device.

SUMMARY OF THE INVENTION

It is an object of the present invention to provide an anti-theft device for limiting the portability of a portable device within a specific range.

It is another object of the present invention to provide an anti-theft device for clamping a portable device to refrain unauthorized persons from operating the portable device.

The anti-theft device for a portable device includes a coupler, an engaging/disengaging device, and a localizer, wherein the portable device includes an aperture. The localizer couples the engaging/disengaging device with an immovable object such as a table. The coupler includes a bridge portion and a leg, wherein the bridge portion includes a through hole corresponding to and aligned with the aperture of the portable device. The bridge portion and the leg are respectively disposed on different sides (e.g. two adjacent sides) of the portable device. The engaging/disengaging device includes an engaging mechanism for engaging with the aperture of the portable device to limit the portability of the portable device within a specific range. Together the engaging/disengaging device and the coupler clamp the portable device so that the portable device is maintained in a folded configuration.

The aperture of the portable device includes a USB receptacle, a threaded aperture, or a dedicated security aperture. The engaging mechanism of the engaging/disengaging device can be modified in order to engage with various available apertures on the portable device.

In different embodiments, the anti-theft device further includes a coupling disc, wherein the coupling disc includes an insertion aperture corresponding to the through hole of the coupler and at least one wedging member. The wedging member is disposed on a side of the coupling disc and includes a convex extending away from a centre axis of the coupling disc. The wedging member is wedged into the through hole so that the convex contacts one of the indentations in the through hole. When the wedging member is fitted into the through hole, the engaging mechanism passes through the insertion aperture of the coupling disc and the through hole of the bridging portion of the coupler to mechanically engage with the aperture of the portable device.

DETAILED DESCRIPTION OF THE PREFERRED EMBODIMENTS

First Embodiment

Figure 1:
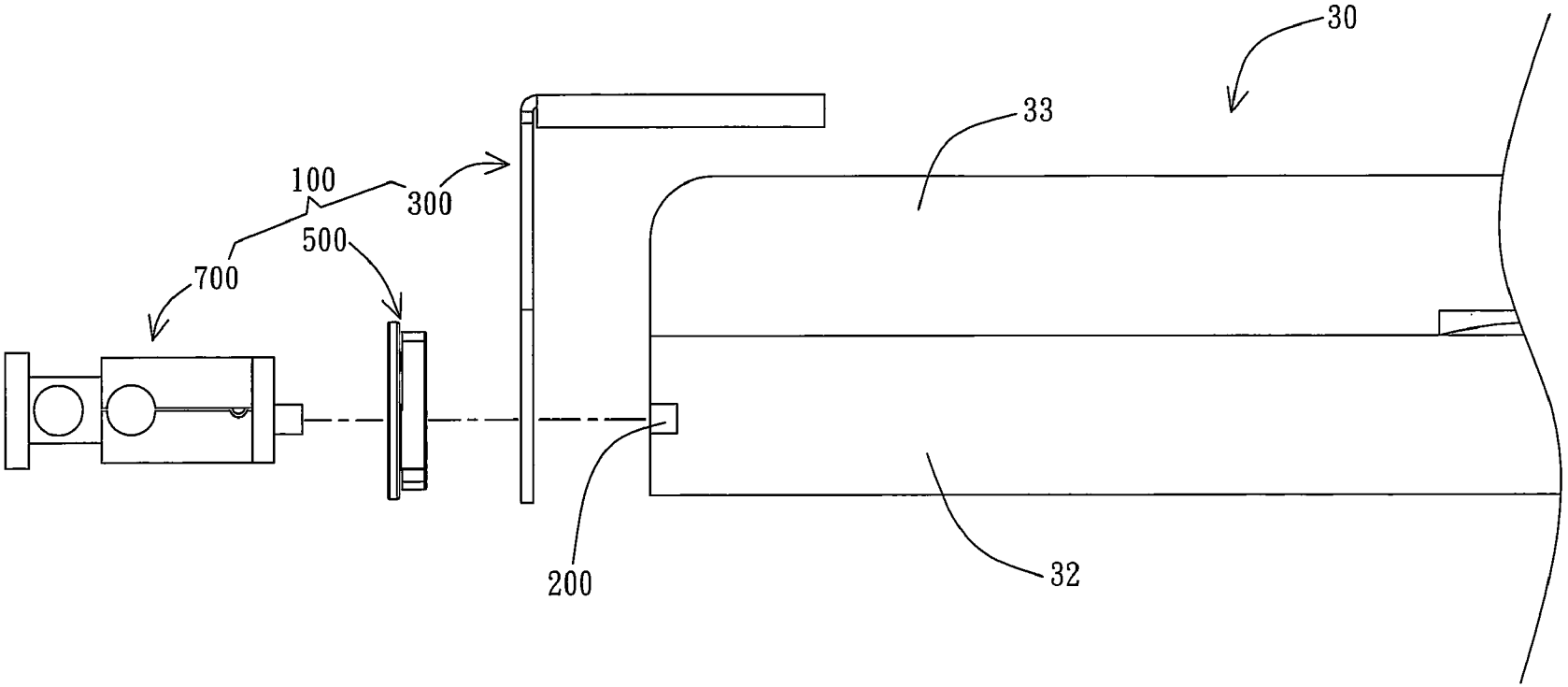
FIG. 1 is a perspective view of an anti-theft device of a first embodiment of the present invention and a laptop computer having a security aperture.

Referring to FIG. 1, an anti-theft device 100 of an embodiment of the present invention uses a localizer (not illustrated) to lock a closed laptop computer 30 to an immovable object such as a leg of a desk. The anti-theft device 100 is also used to maintain the laptop computer 30 in a folded/closed configuration. The laptop computer 30 includes a housing 32 and a hinged member 33 pivotally coupled to the housing 32. The hinged member 33 is normally provided to accommodate the display screen of the laptop computer 30. The housing 32 is normally provided to accommodate a processing unit and a keyboard of the laptop computer 30.

Referring to FIG. 1, a dedicated security aperture 200 is disposed at one side of the housing 32 to be engaged with the anti-theft device 100 of the present invention. The anti-theft device 100 has a coupler 300, a coupling disc 500, and an engaging/disengaging device 700. A localizer (not illustrated) such as a cable lock system, a padlock, or a combination thereof may be used to lock the anti-theft device 100 to an immovable object. Thus, the portability of the laptop computer 30 is limited by the length or the type of the localizer used. The coupling disc 500 is disposed between the coupler 300 and the engaging/disengaging device 700 and is used to mechanically couple the coupler 300 together with the engaging/disengaging device 700. The coupler 300 extends over the top surface of the hinged member 33 of the laptop computer 30. The engaging/disengaging device 700 can be fastened to the housing 32 of the laptop computer 30 through the security aperture 200 on the housing 32 of the laptop computer 30. Thus the engaging/disengaging device 700 and the coupler 300 together can maintain the laptop computer 30 in the folded configuration.

Figure 2:
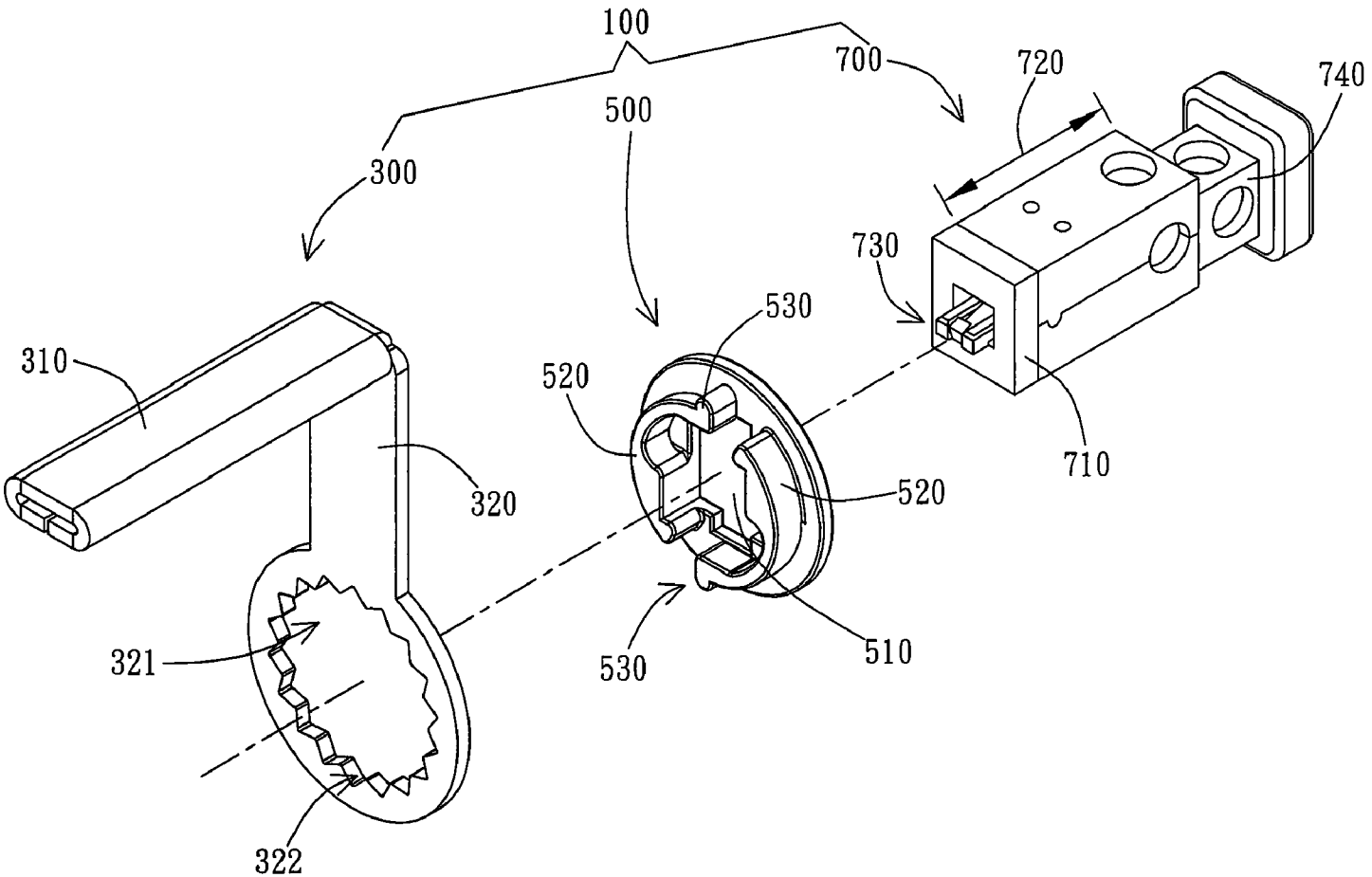
FIG. 2 is an exploded view of the anti-theft device according to the first embodiment of the present invention.

FIG. 2 is an exploded view of an embodiment of the anti-theft device 100 having a coupler 300, a coupling disc 500, and an engaging/disengaging device 700. The coupler 300 has a leg 310 and a bridge portion 320. In the present embodiment, one end of the leg 310 is connected to one end of the bridge portion 320. The leg 310 and the bridge portion 320 can be completely joined. For example, as shown in FIG. 2, the leg 310 extends from one end of the bridge portion 320, so that the leg 310 and the bridge portion 320 can be disposed on different sides of the portable device, e.g. two adjacent sides of the portable device. The leg 310 is preferred to have an elongated flat and straight shape to facilitate the arrangement of the leg 310 on the hinged member 33 of the laptop computer 30, but is not limited thereto. The leg 310 is used to be horizontally disposed on the top surface of the hinged member 33 of the laptop computer 30 (not illustrated). The bridge portion 320 has a through hole 321 and a plurality of indentations 322 disposed around the perimeter of the through hole 321. Before engaging, the coupler 300 is rotatably coupled to the coupling disc 500 and the through hole 321 is preferred to have a circular shape, but is not limited thereto. In the present embodiment, each indentation 322 preferably has a corresponding indentation 322 disposed directly opposite to each other. In other words, one indentation 322 and the corresponding indentation 322 are preferred to face each other and thus form a pair. However, the indentations 322 are not necessarily formed in pair, and thus each indentation 322 does not necessarily have a corresponding indentation 322. The number and the width of indentations 322 depend on the angular adjustability requirement of the coupler 300. The part of the bridge portion 320 surrounding the through hole 321 is preferred to have a shape corresponding to that of the through hole 321.

Referring to FIG. 2, the coupling disc 500 is used to mechanically couple the coupler 300 together with the engaging/disengaging device 700. The coupling disc 500 of the present embodiment has a circular shape but is not limited thereto. The coupling disc 500 may have a square shape or other shapes. The coupling disc 500 includes an insertion aperture 510 and at least one wedging member 520 which is disposed on one side of the coupling disc 500. In the present embodiment, the coupling disc 500 has a pair of wedging members 520. The insertion aperture 510 is used to allow the engaging/disengaging device 700 to pass through to engage with the security aperture 200. The wedging members 520 are preferred to have identical shape and to be distributed around the insertion aperture 510, but are not limited thereto. Each of the wedging members 520 has at least one convex 530 which is used to wedge into one of the indentations 322 disposed around the perimeter of the through hole 321. The number of convexes disposed depends on the coupling strength required between the coupler 300 and the coupling disc 500.

Figure 3A:
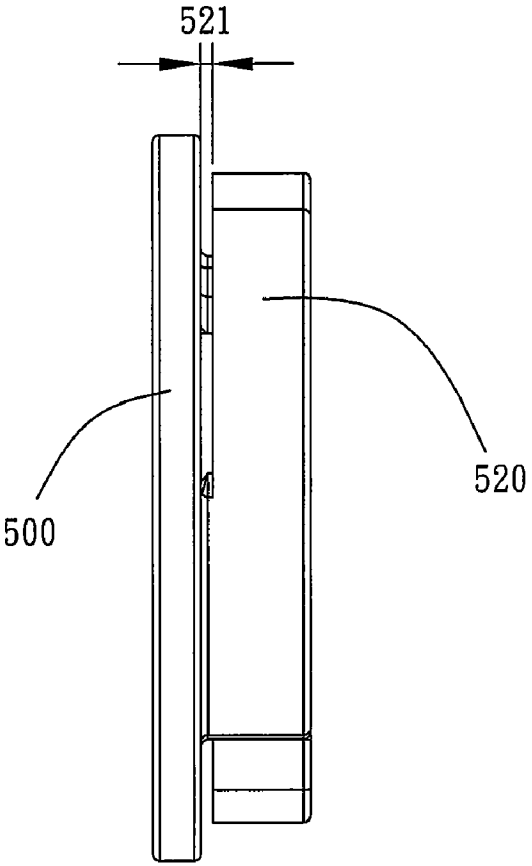
FIG. 3A, FIG. 3B, FIG. 3C, and FIG. 3D illustrate perspective views of the anti-theft device of the first embodiment of the present invention, wherein the coupler is rotated with respect to the coupling disc.

Referring to FIG. 3A, in the present embodiment, the wedging member 520 is preferably flexibly disposed around the insertion aperture of the coupling disc 500. That is, the wedging member 520 is not completely connected with the coupling disc 500. Thus, a gap 521 occurs between the coupling disc 500 and the wedging member 520. In this way, the wedging member 520 is able to slightly bend towards the insertion aperture 510 when a force is applied on the disconnected part of wedging member 520.

Figure 3D:
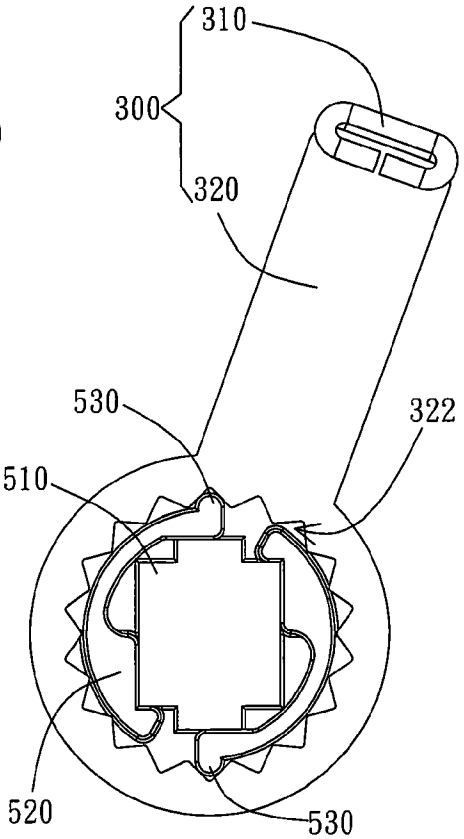
Figure 3C:
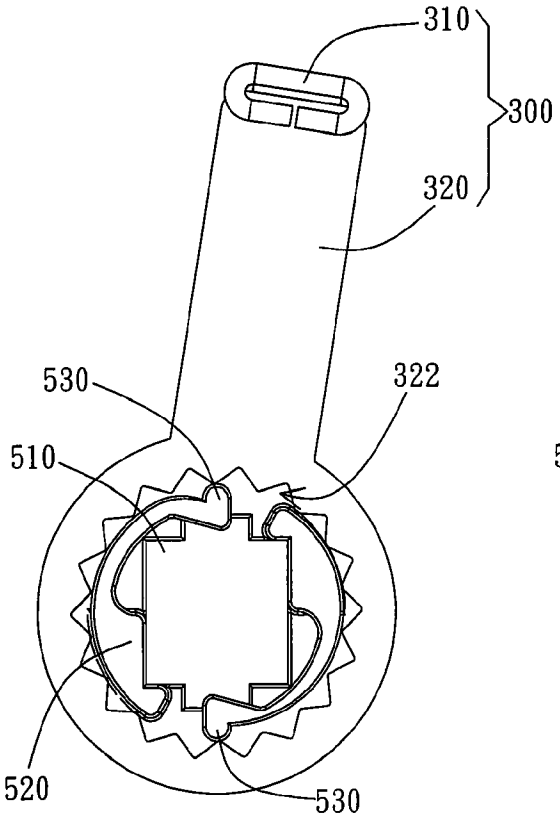
Figure 3B:
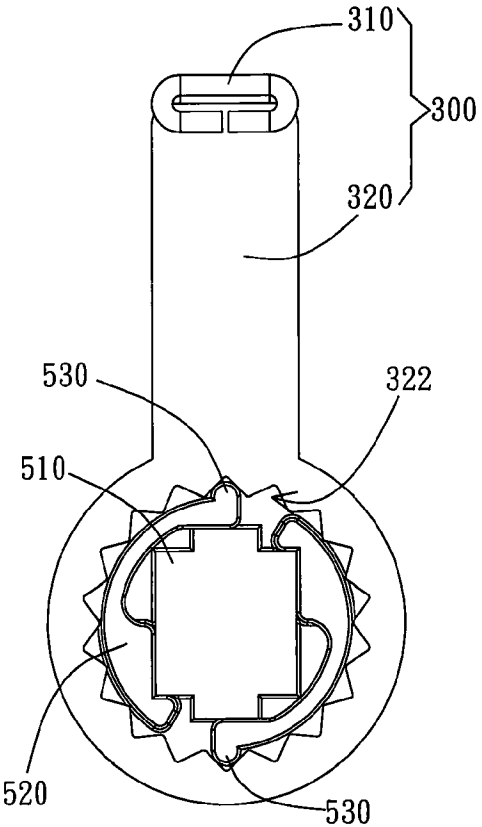

Referring to FIG. 3B, the coupler 300 of the present embodiment is steady and has not yet been rotated by the user. As FIG. 3B shows, in the present embodiment, one convex 530 of the wedging member 520 wedges into one indentation 322 to maintain the coupler 300 in position.

Referring to FIG. 3C, in the present embodiment, when the coupler 300 is rotated in a clockwise direction, the convex 530 of the wedging member 520 is under a downward force from one indentation 322. Thus, the wedging member 520 is bent and the convex 530 is shifted towards the insertion aperture 510 by the indentation 322 which allows the coupler 300 to rotate clockwise.

Referring to FIG. 3D, the coupler 300 has rotated clockwise and thus the convex 530 of the wedging member 520 now wedges into a different indentation 322, i.e. the next indentation. The clockwise and/or counterclockwise direction mentioned above is relative to FIG. 3B, FIG. 3C, and FIG. 3D when viewing from the insertion aperture 510.

However, in the present embodiment, the part of wedging members 520 joined together with the coupling disc 500 will not bend under the applied force. Thus, the wedging members 520 will only bend in one direction. In the present embodiment, the coupler 300 coupled to the coupling disc 500 can only rotate in one direction, either clockwise or counterclockwise direction. However, the rotating direction of the coupler 300 depends on the orientation of the hinged member 33 of the laptop computer 30. The wedging member 520 of the present embodiment is preferred to be curved but not limited thereto. The wedging member 520 can have a straight shape or other shapes. In the present embodiment, one convex 530 of the wedging member 520 is opposite to the other convex 530. Thus, one convex 530 will wedge into one of the indentations 322, while the other convex 530 is wedged into the indentation 322 opposite to the above-mentioned indentation 322. The coupler 300 is coupled with the coupling disc 500 by wedging the two convexes 530 into the indentations 322 of the coupler 300. The coupler 300 can rotate in only one direction; thus when the coupler 300 is rotated until the leg 310 horizontally touches against the hinged member 33, the coupler will be fixed and can only be released by disengaging the engaging/disengaging device 700 and removing the coupling disc 500. The insertion aperture 510 is provided to allow the engaging/disengaging device 700 to pass through to engage with the laptop computer 30. The engaging/disengaging device 700 is preferred to pass through the insertion aperture 510 from the side of the coupling disc 500 without the wedging members 520 disposed thereon.

It is to be noted that components of the anti-theft device 100 can be interchanged. For example, the insertion aperture 510 and the wedging member 520 of the coupling disc 500 can be interchanged with the through hole 321 of the bridging portion 320 of the coupler 300. In this way, the insertion aperture 510 and the wedging member 520 are disposed on the bridge portion 320 of the coupler 300; whereas the through hole 321 with indentations 322 is disposed on the coupling disc 500. However, the working principle between the coupler 300 and the coupling disc 500 remains the same, despite the interchange of components.

Figure 4A:
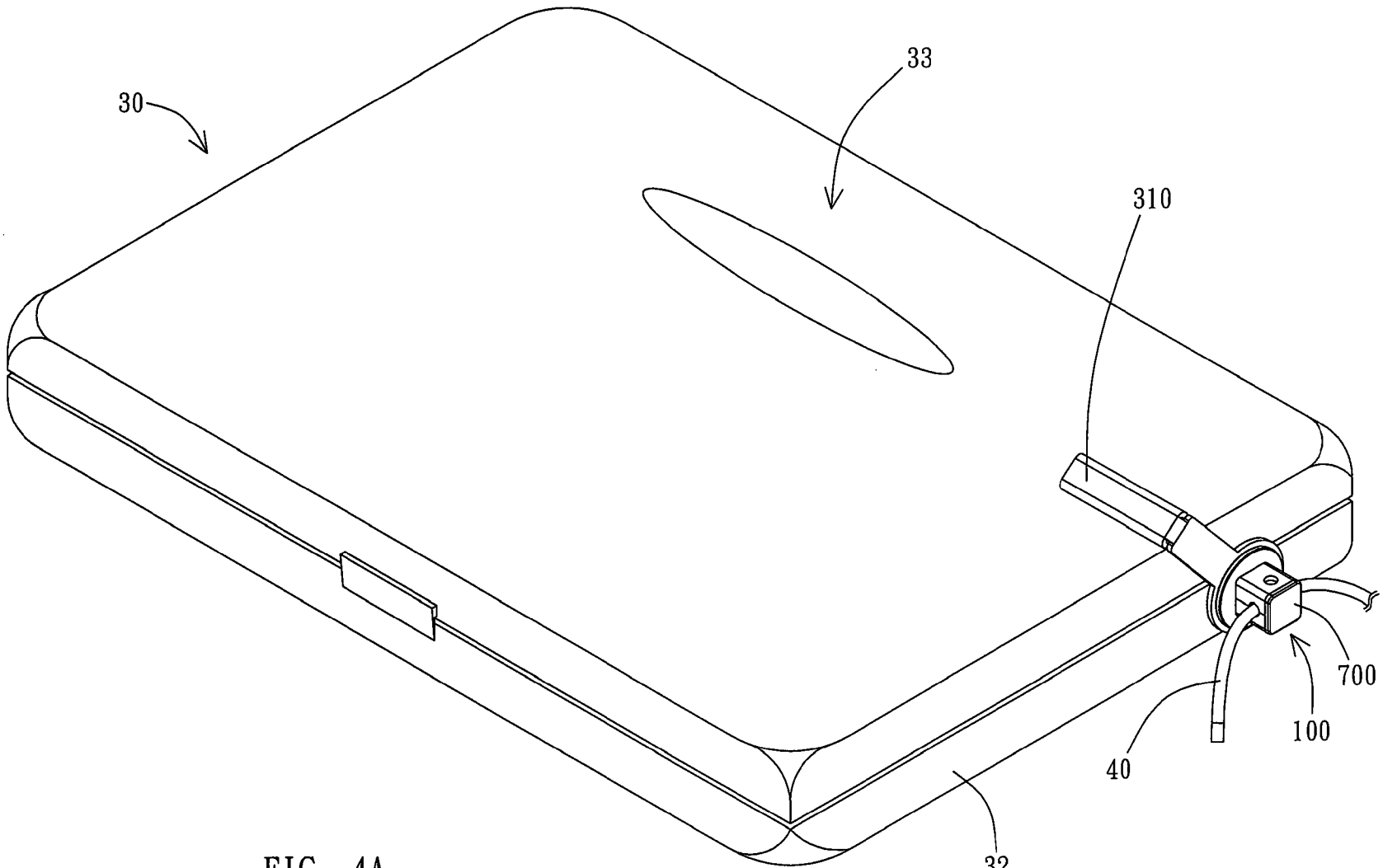
FIG. 4A and FIG. 4B are perspective views illustrating the anti-theft device of the first embodiment of the present invention which is fastened to a folded laptop computer, wherein a localizer is used to lock the laptop computer to an immovable object.
Figure 4B:
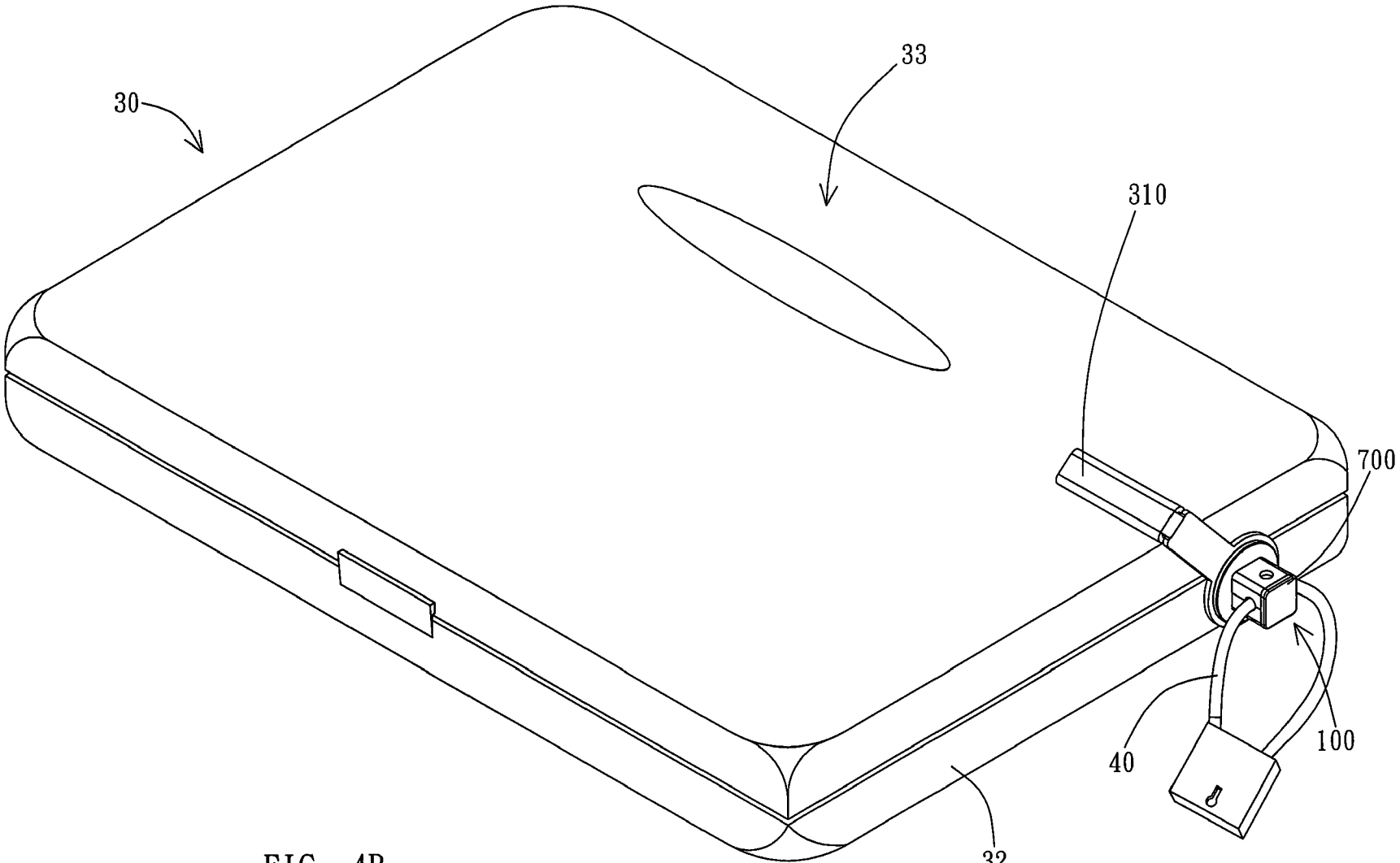

FIG. 4A and FIG. 4B are perspective views of the anti-theft device of the first embodiment of the present invention which is fastened to a folded laptop computer 30. The anti-theft device 100 engages with the security aperture 200 (not illustrated) formed on the housing 32 of the laptop computer 30. The leg 310 of the coupler 300, on the other hand, is horizontally attached to the hinged member 33 of the laptop computer 30, while the bridge portion 320 is disposed on an adjacent sidewall of the hinged member 33. As shown in FIG. 4A and FIG. 4B, a localizer 40 in a form of a cable lock system or a padlock is used to lock the anti-theft device 100 to an immovable object such as a leg or a surface of a table (not illustrated). Thus, the localizer 40 limits the portability of the laptop computer 30. It can be seen from FIG. 4A and FIG. 4B that the coupler 300 of the anti-theft device 100 prevents the folded laptop computer 30 from being opened. The folded laptop computer 30 can only be released when the anti-theft device 100 is disengaged. As it has been explained in the previous paragraphs, the coupler 300 is preferably designed to be rotatable in only one direction. Thus, the coupler 300 cannot be further rotated once the leg 310 of the coupler 300 has horizontally touched against the hinged member 33 of the laptop computer 30. The engaging/disengaging device 700 is first removed before the coupler 300 can be removed to release the folded laptop computer 30.

Referring back to FIG. 2, the engaging/disengaging device 700 is used to fasten itself, the coupler 300, and the coupling disc 500 of the present embodiment to the laptop computer 30. The engaging/disengaging device 700 includes a cushion 710, a casing 720, an engaging mechanism 730, and a push-pull switch 740. The cushion 710 is disposed between the casing 720 and the security aperture 200 to increase the coupling strength between the engaging/disengaging device 700 and the security aperture 200. The casing 720 is used to integrate the push-pull switch 740, the engaging mechanism 730 and the cushion 710 to form the engaging/disengaging device 700. The engaging mechanism 730 is used to pass through the insertion aperture 510 of the coupling disc 500 and the through hole 321 and then engages with the security aperture 200 of the laptop computer 30. Thus, the engaging/disengaging device 700 and the coupler 300 clamp the laptop computer 30 and maintain the laptop computer 30 in the folded configuration. A localizer such as a cable lock system (not illustrated) can be used to lock the anti-theft device 100 on an immovable object (not illustrated). The push-pull switch 740 is used to alternate the position of the engaging/disengaging device between an engaging position and a disengaging position.

Figure 5:
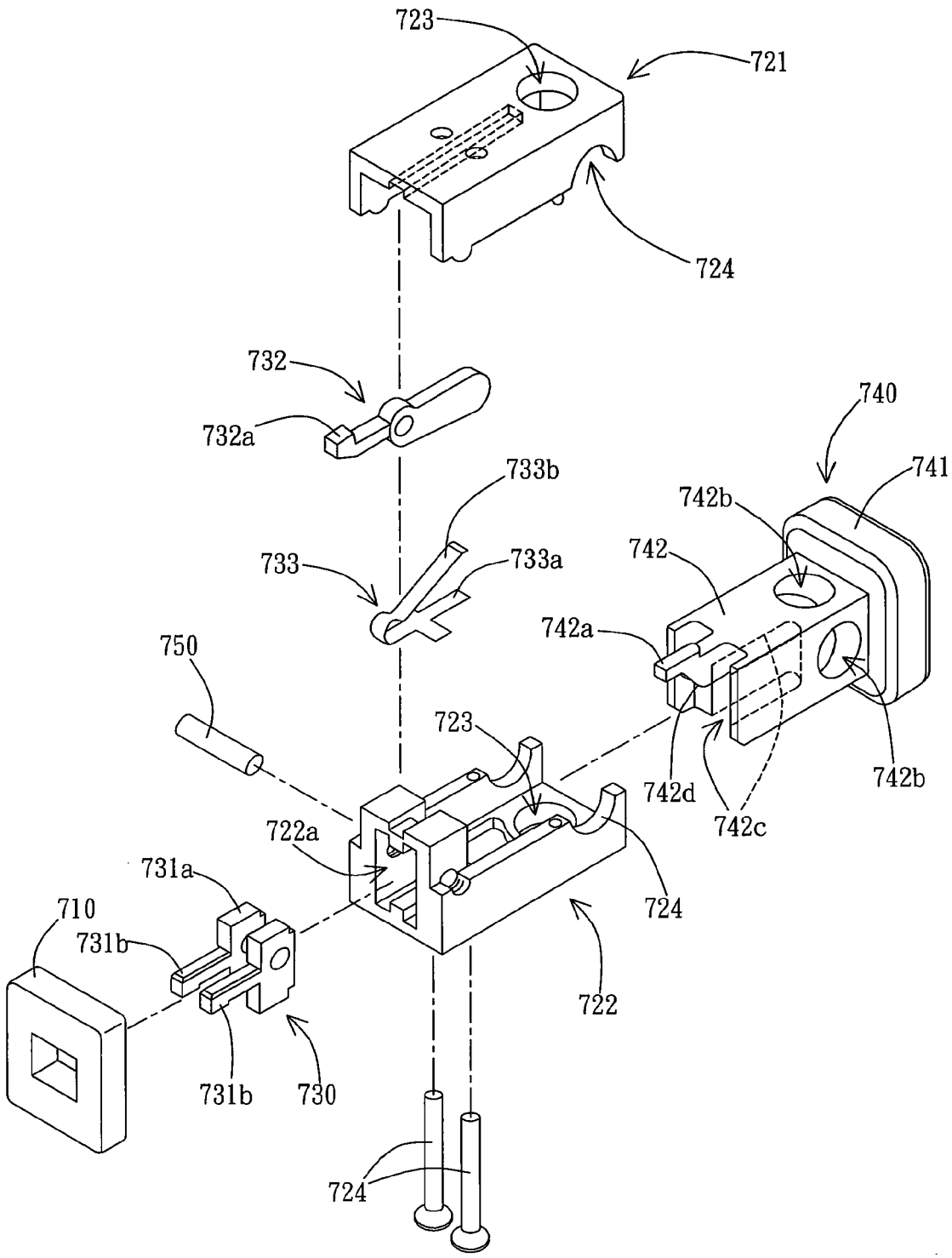
FIG. 5 is an exploded view of the engaging/disengaging device of the anti-theft device according to the first embodiment of the present invention

FIG. 5 is an exploded view of the engaging/disengaging device 700. In the present embodiment, the casing 720 further includes an upper casing 721 and a lower casing 722. The upper casing 721 can couple with the lower casing 722 with adhesive or through wielding. The upper casing 721 and the lower casing 722 includes a localizer aperture 723 respectively. The upper casing 721 and the lower casing 722 also includes a pair of grooves 724 respectively, wherein two grooves 724 couples with each other to form another localizer aperture 723. In other words, there are in total four localizer apertures 723 when the upper casing 721 couples with the lower casing 722. The localizer apertures 723 are provided for the localizer to pass through and to lock the anti-theft device 100 to an immovable object.

Referring to FIG. 5, the engaging mechanism 730 includes a fixed hook 731, a mobile hook 732 and an elastic element 733. The base 731*a* of the fixed hook 731 is immovably fitted into the fitting aperture 722*a* of the lower casing 722. In the present embodiment, the fixed hook 731 further includes a pair of pins 731*b* passing through an aperture of the cushion 710. A space is kept between the pair of pins 731*b*. The base foot 733*a* of the elastic element 733 is disposed on the inner surface of the lower casing 722. The mobile hook 732 is disposed on the upper foot 733*b* of elastic hook 733. Thus, the bottom surface of the mobile hook 732 is constantly under an upward force from the upper foot 733*b*. The hook tip 732*a* of the mobile hook 732 is disposed between the pair of pins 731*b* of the fixed hook 731. The fixed hook 731, the mobile hook 732, and the lower casing 722 are coupled together with a coupling shaft 750.

Referring to FIG. 5, the push-pull switch 740 includes a button 741 and a body 742. The button 741 is used as a human interface which allows the user to alternate the position of the engaging mechanism 730 to engage or disengage the security aperture 200, by pushing or pulling the button 741. In the present embodiment, the button 741 has a square shape, but is not limited thereto. The button 741 can have a circular shape or other shapes, depending on the usability requirement of the design. The body 742 has a push arm 742*a* and four inner lock apertures 742*b*, while each inner lock aperture 742*b* corresponds to one localizer aperture 723. One inner lock aperture 742*b* will align with one localizer aperture 723 when the button 741 is pushed to allow the localizer to pass through. The body 742 has a through hole 742*c* to accommodate the mobile hook 732 and the elastic element 733. The push arm 742*a* includes a slant surface 742*d*. The slant surface 742*d* will press down the mobile hook 732 when the button 741 is pushed by the user which then raises the hook tip 732*a* of the mobile hook 732. The pair of pins 731*b* of the fixed hook 731 and thus the hook tip 732*a* of the mobile hook 732 will not be aligned and engaged with the inner wall of the housing 32 (not illustrated). On the other hand, if the button 741 is pulled, then the upper foot 733*b* of the elastic element 733 will push the mobile hook 732 upwards and thus lower the hook tip 732*a*. The hook tip 732*a* of the mobile hook 732 will be aligned. Thus, engaging/disengaging device 700 disengages from the security aperture 200. The action of pulling the button 741 will effectively disengage the engaging/disengaging device 700 from the security aperture 200.

First Variation of the First Embodiment

Figure 6:
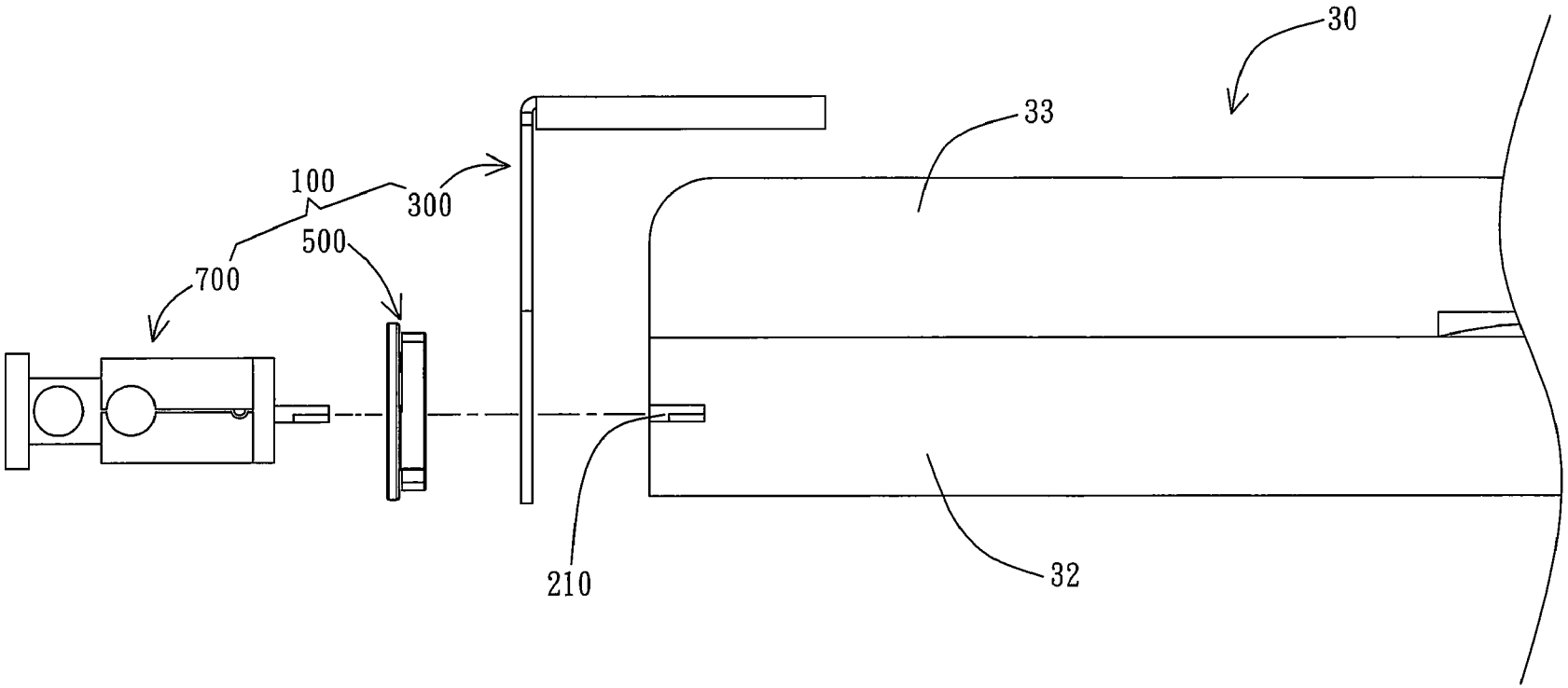
FIG. 6 illustrates a first variation of the first embodiment of the anti-theft device which engages with a USB (Universal Serial Bus) receptacle on a laptop computer.

FIG. 6 is a first variation of the first embodiment. In the present embodiment, the anti-theft device engages with a USB (Universal Serial Bus) receptacle 210 available on the housing 32 of the laptop computer 30. Depending on the number of USB receptacle 210 and the distance between USB receptacles 210, the anti-theft device 100 can be modified to be fastened to the laptop computer 30 through one or more USB receptacles 210. The coupler 300 and the coupling disc 500 remains the same and thus the interface as well as the working principle between the coupler 300 and the coupling disc 500 remain the same. However, the engaging/disengaging device is slightly modified in order to interface and to engage or to disengage the USB receptacle 210 disposed on the housing 32 of the laptop computer 30. For example, the engaging/disengaging device is modified to have a USB connector for the USB receptacle 210. Thus, the working principle of the present embodiment is identical to that of the first embodiment and will not be elaborated again.

Second Variation of the First Embodiment

Figure 7:
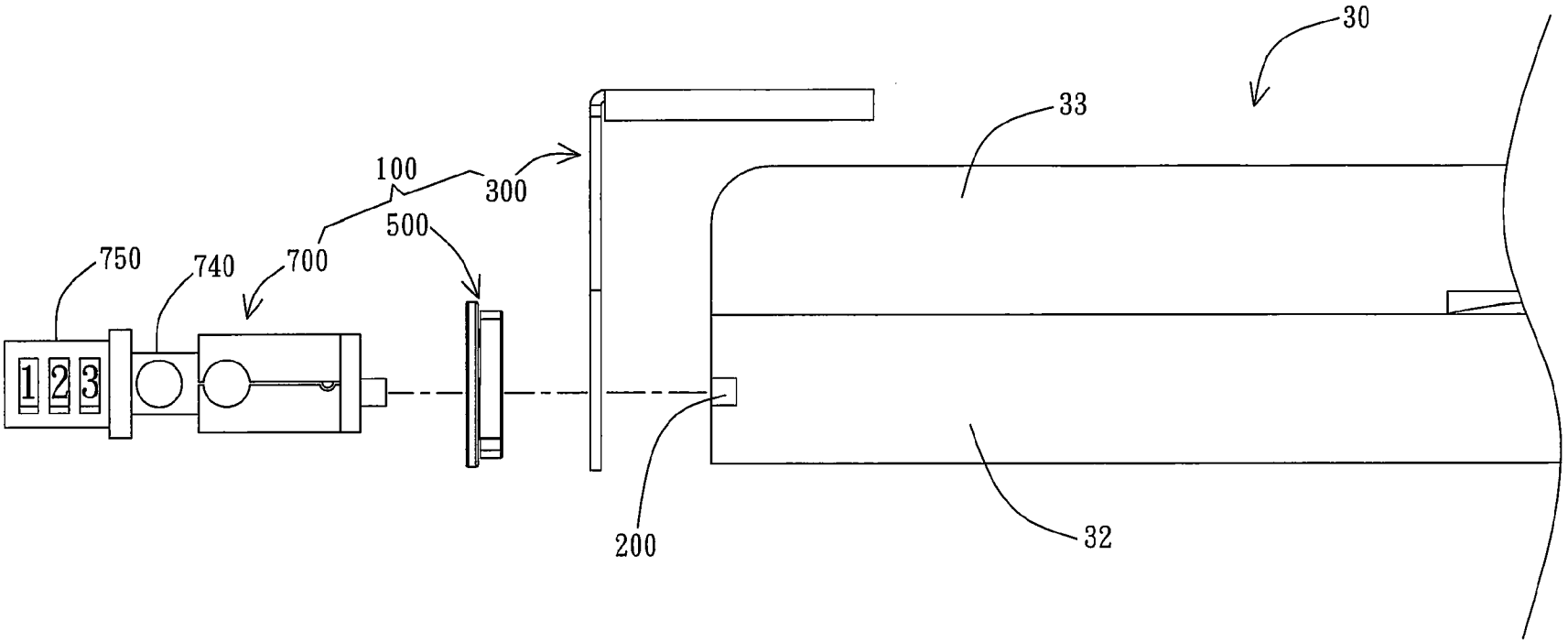
FIG. 7 illustrates a second variation of the first embodiment of the anti-theft device wherein a combination lock is integrated into the anti-theft device.

FIG. 7 is a second variation of the first embodiment. In the present embodiment, the engaging/disengaging device 700 further includes a combination lock 750 which is used to fix the engaging/disengaging device 700 when the push-pull switch 740 is pushed. The coupler 300 and the coupling disc 500 remain the same; thus the working principle of the coupler 300 and that of the coupling disc 500 remains the same. However, the engaging/disengaging device 700 has an internal structure similar to the invention disclosed in the U.S. Pat. No. 6,058,744, issued on May 9, 2000—entitled "Combination lock having pivotal latch insertable and lockable in an object aperture". The combination lock 750 is used to lock the engaging/disengaging device 700 in position when the push-pull switch 740 is pushed to engage with the security aperture 200. Afterwards the combination lock 750 has to be unlocked before the push-pull switch 740 can be pulled again. In the present embodiment, the combination lock 750 is preferred to be a multi-dial combination lock, but is not limited thereto. The combination lock 750 can be a single-dial combination lock or an electronic combination lock.

Third Variation of the First Embodiment

Figure 8:
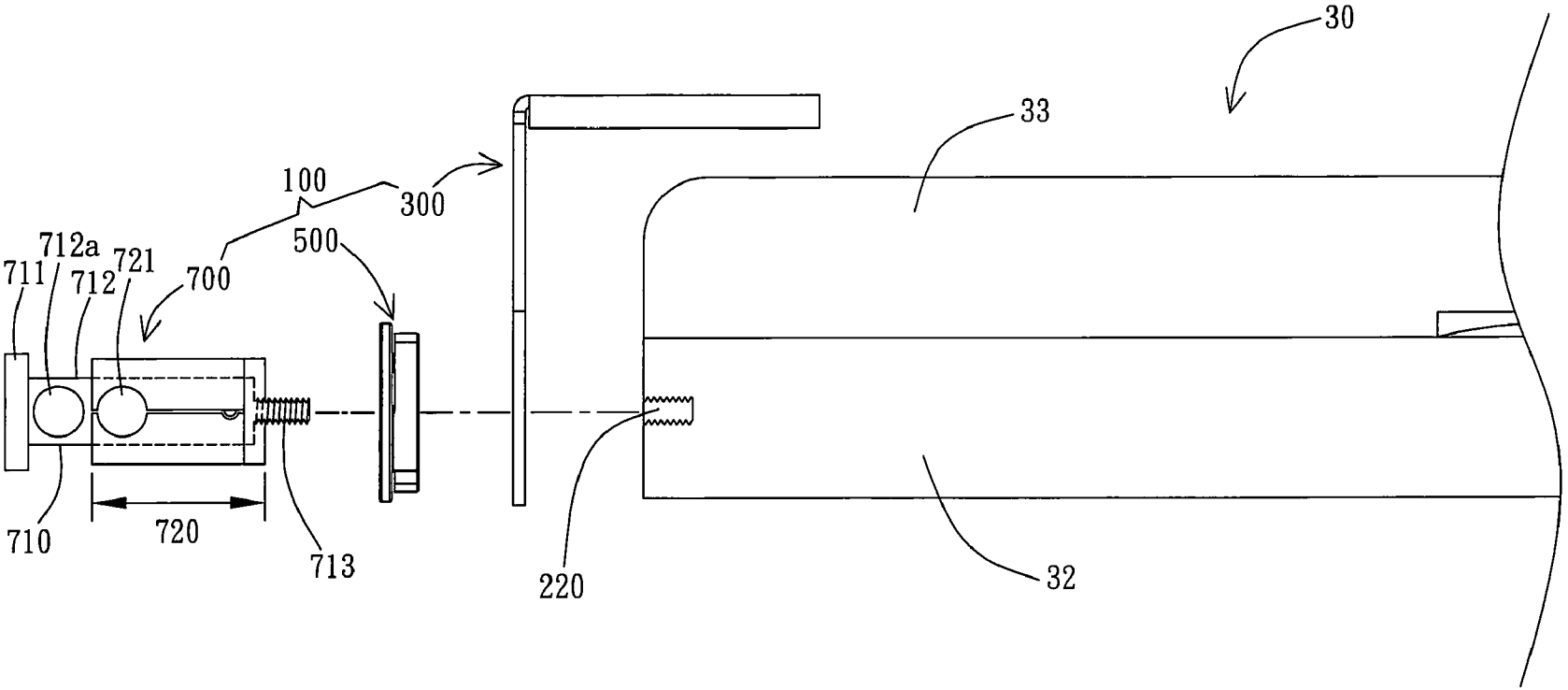
FIG. 8 is a perspective view of a third variation of the first embodiment of the anti-theft device of the present invention, wherein the anti-theft device rotatably couples with a threaded aperture on the laptop computer.

FIG. 8 illustrates a third variation of the anti-theft device 100 of the first embodiment. The anti-theft device 100 also has a coupler 300, a coupling disc 500, and an engaging/disengaging device 700. However, in the present embodiment, the coupler 300 and the coupling disc 500 are identical to those in the first embodiment, but are not limited thereto. The engaging/disengaging device 700 is modified to rotatably engage with the threaded aperture 220 disposed on the housing 32 of the laptop computer 30. In the present embodiment, the engaging/disengaging device 700 has a rotary member 710, and a casing 720. Please note the rotary member 710 serves as the engaging mechanism of the first embodiment for engaging with the security aperture 200 of the laptop computer 30. The rotary member 710 includes a handle 711, a core 712, and at least one screw 713. The handle 711 is provided as a human interface for the user to rotate the rotary member 710 so as to rotatably engage the screw 713 with the threaded aperture 220. The surface of the core 712 is threaded in accordance with the threaded inner surface of the casing 720. The core 712 further includes an inner localizer aperture 712*a* and is joined with the screw 713

The rotary member 710 has a screw 713 which is used to rotatably couple with the threaded aperture 220 disposed on the laptop computer 30. The casing 720 accommodates the rotary member 710, and the inner surface of the casing 720 is threaded. In the present embodiment, the casing 720 has a rectangular shape, but is not limited thereto. The casing 720 may have a cylindrical shape or other shapes. The casing 720 further includes a screw aperture 721 for the screw 713 to pass through and to rotatably couple with the threaded aperture 220 disposed on the laptop computer 30. The screw bore 721 is preferred to be threaded in accordance with the screw 713, but is not limited thereto.

The rotary member 710 includes a handle 711, a core 712, and at least one screw 713. The handle 711 is provided as a human interface for the user to rotate the rotary member 710 to rotatably engage the screw 713 with the threaded aperture 220. The surface of the core 712 is threaded in accordance with the threaded inner surface of the casing 720. Thus, the core 712 can rotatably couple with the casing 720. The core 712 further includes an inner localizer aperture 712*a*. The inner surface of the casing 720 is threaded to correspond to the thread on the outer surface of the rotary member 710. The rotary member 710 has an inner localizer aperture 712*a* while the casing 720 has an outer localizer aperture 721. When the rotary member 710 is rotatably coupled with the casing 720, the inner localizer aperture 712*a* will align with the outer localizer aperture 721 to allow a localizer (not illustrated) to pass through and to lock the engaging/disengaging device 700 to an immovable object (not illustrated).

Second Embodiment

Figure 9:
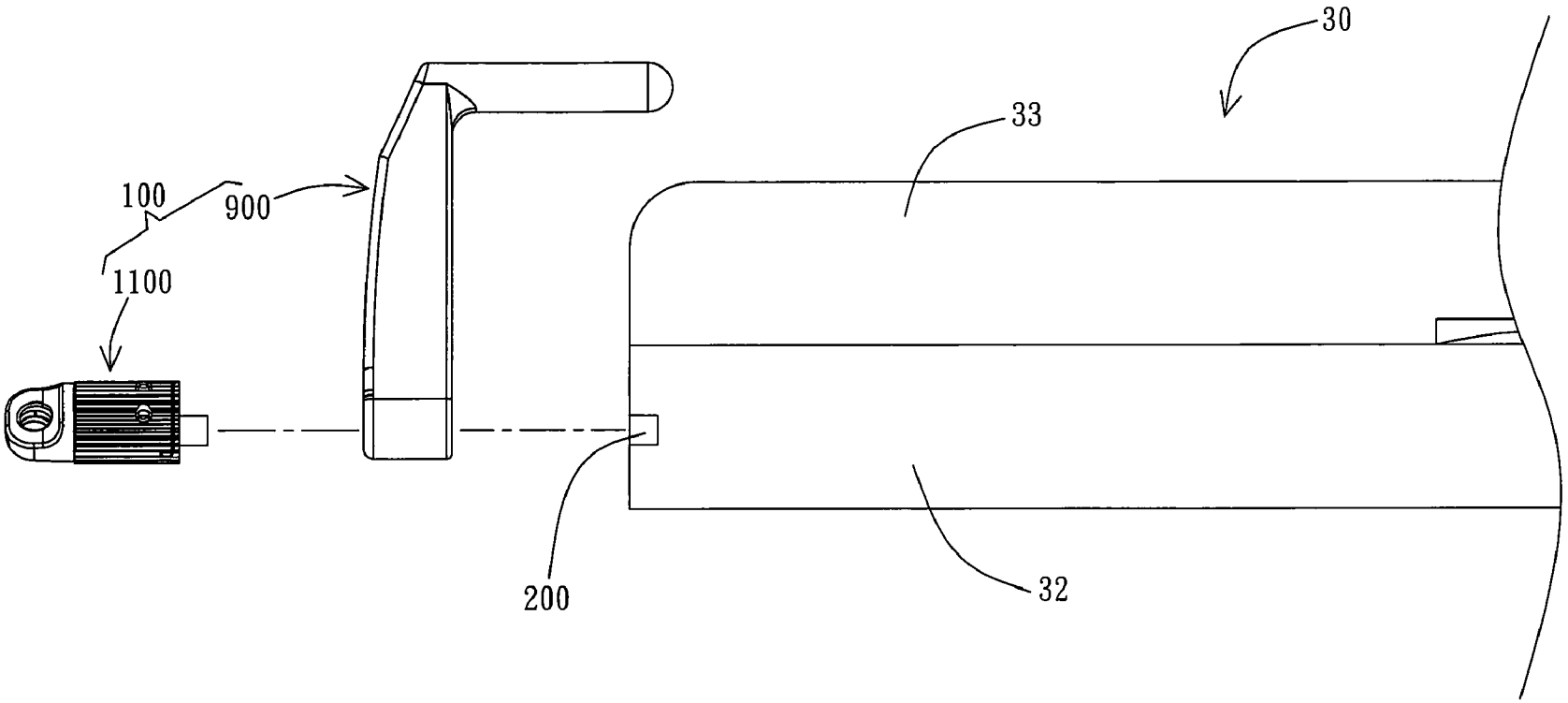
FIG. 9 is a perspective view of an anti-theft device according to a second preferred embodiment of the anti-theft device of the present invention.

Referring to FIG. 9, an anti-theft device 100 according to another preferred embodiment of the present invention is illustrated. The anti-theft device 100 of the present embodiment is used together with a localizer (not illustrated) to lock a folded laptop computer 30 to an immovable object (not illustrated). The anti-theft device 100 of the present embodiment can maintain the laptop computer 30 in a folded configuration. The laptop computer 30 includes a housing 32 and a hinged member 33 pivoted to the housing 32. The hinged member 33 is normally provided to accommodate the computer screen. The housing 32, on the other hand, is normally provided to accommodate a processing unit and a keyboard. A dedicated security aperture 200 is disposed at one of the walls of the housing 32 to be engaged with the anti-theft device 100 of the present embodiment.

Referring to FIG. 9, the anti-theft device 100 has a coupler 900 and an engaging/disengaging device 1100. The engaging/disengaging device 1100 serving as the engaging mechanism of the first embodiment will engage with the security aperture 200 of the laptop computer 30. A localizer (not illustrated) such as a cable lock system, a padlock, or a combination thereof may be used to tie the anti-theft device 100 to an immovable object (not illustrated). Thus, the portability of the laptop computer 30 is limited to the length or the type of the localizer used. The coupler 900 extends over the top surface of the hinged member 33 of the laptop computer 30 and is fixedly coupled with the engaging/disengaging device 1100.

Figure 10:
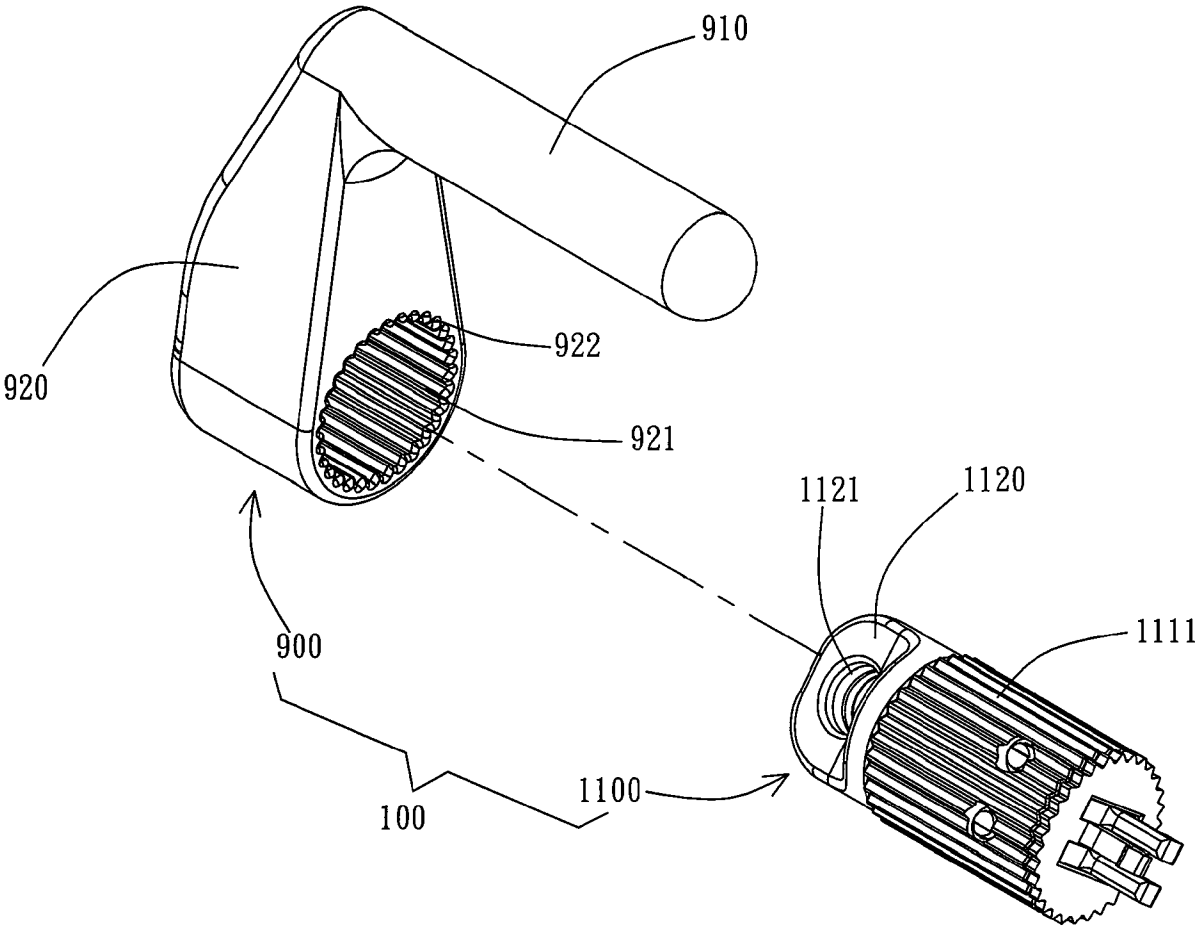
FIG. 10 is an exploded view of the anti-theft device according to the second embodiment of the present invention.

Referring to FIG. 10, the anti-theft device 100 of the present embodiment of the present invention having a coupler 900 and an engaging/disengaging device 1100 is illustrated. The coupler 900 includes a leg 910 and a bridge portion 920. In the present embodiment, one end of the leg 910 is completely joined to one end of the bridge portion 920, but is not limited thereto. The leg 910 is provided to contact or disposed over the top surface of the hinged member 33 of the laptop computer 30. In the present embodiment, the leg 910 has a cylindrical shape, but is not limited thereto. The leg 910 can have an elongated flat shape. The bridge portion 920 has a through hole 921 with two openings on two sides of the bridge portion 920, and a plurality of indentations 922 are disposed around the perimeter of the through hole 921. The through hole 921 is provided to accommodate the engaging/disengaging device 1100.

Referring to FIG. 10, the engaging/disengaging device 1100 is used to fasten the anti-theft device 100 of the present invention to the laptop computer 30, through the security aperture 200. The engaging/disengaging device 1100 has a similar internal structure and working principle to those of the engaging/disengaging device of the first embodiment. However, in the present embodiment, the shape and the size of the engaging/disengaging device 1100 correspond to those of the through hole 921 of the coupler 900. The engaging/disengaging device 1100 has a cylindrical shape and a plurality of matching indentations 1111 which correspond to the indentations 922 of the coupler 900. Thus, the engaging/disengaging device 1100 may be fitted into the through hole 921 of the coupler 900. The engaging/disengaging device 1100 has only one lock aperture for a localizer (not illustrated) to pass through to lock the anti-theft device 100 of the present embodiment to the laptop computer 30. In this way, the localizer (not illustrated) such as a tumbler or a cable lock system inhibits the coupler 910 to be separated from the engaging/disengaging device 1100.

Referring to FIG. 10, the coupler 900 and the engaging/disengaging device 1100 are fixedly coupled together. However, the coupling disc 500 in the anti-theft device of the first embodiment can be modified to be adapted to couple the coupler 900 together with the engaging/disengaging device 1100. Furthermore, certain aspects of the coupling disc 500 such as the number of wedging member will be modified in accordance with the indentations 922 disposed around the surface of the through hole 921. Thus, the coupling disc 500 is rotatably couple with the coupler 900. The coupler 900 is preferred to rotate in either clockwise or counterclockwise direction with respect to the coupling disc 500.

Figure 11:
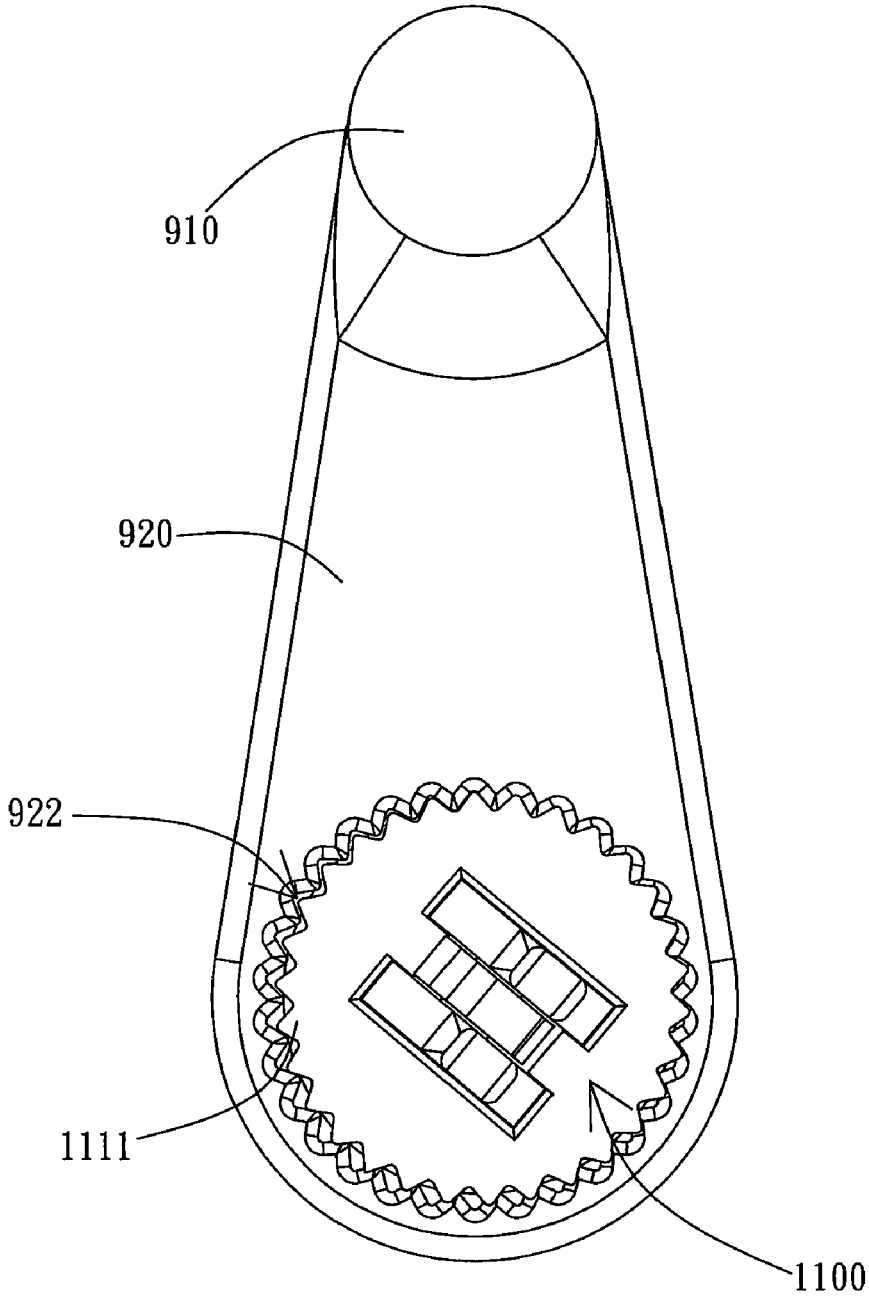
FIG. 11 is a side view of the anti-theft device illustrating the connection between the coupler and the engaging/disengaging device.

As shown in FIG. 11, the engaging/disengaging device 1100 couples with the coupler 900. The engaging/disengaging device 1100 passes through the through hole 921 (not illustrated) of the coupler 900. In this way, the matching indentation 1111 of the engaging/disengaging device 1100 will fit into the indentation 922 of the coupler 900. It is preferred that the size of the through hole 921 (not illustrated) corresponds to the size of the engaging/disengaging device 1100. Thus, the engaging/disengaging device 1100 can be fitted into the through hole 921 with as less space between them as possible and thus prevents vibration between the engaging/disengaging device 1100 and the coupler 900 from occurring. In the present embodiment, the coupler 900 fixedly couples with the engaging/disengaging device 1100. Thus, the orientation of the engaging/disengaging device 1100 can be varied in accordance with the position of the security aperture 200 on the laptop computer 30 and the orientation of the coupler 900.

Figure 12A:
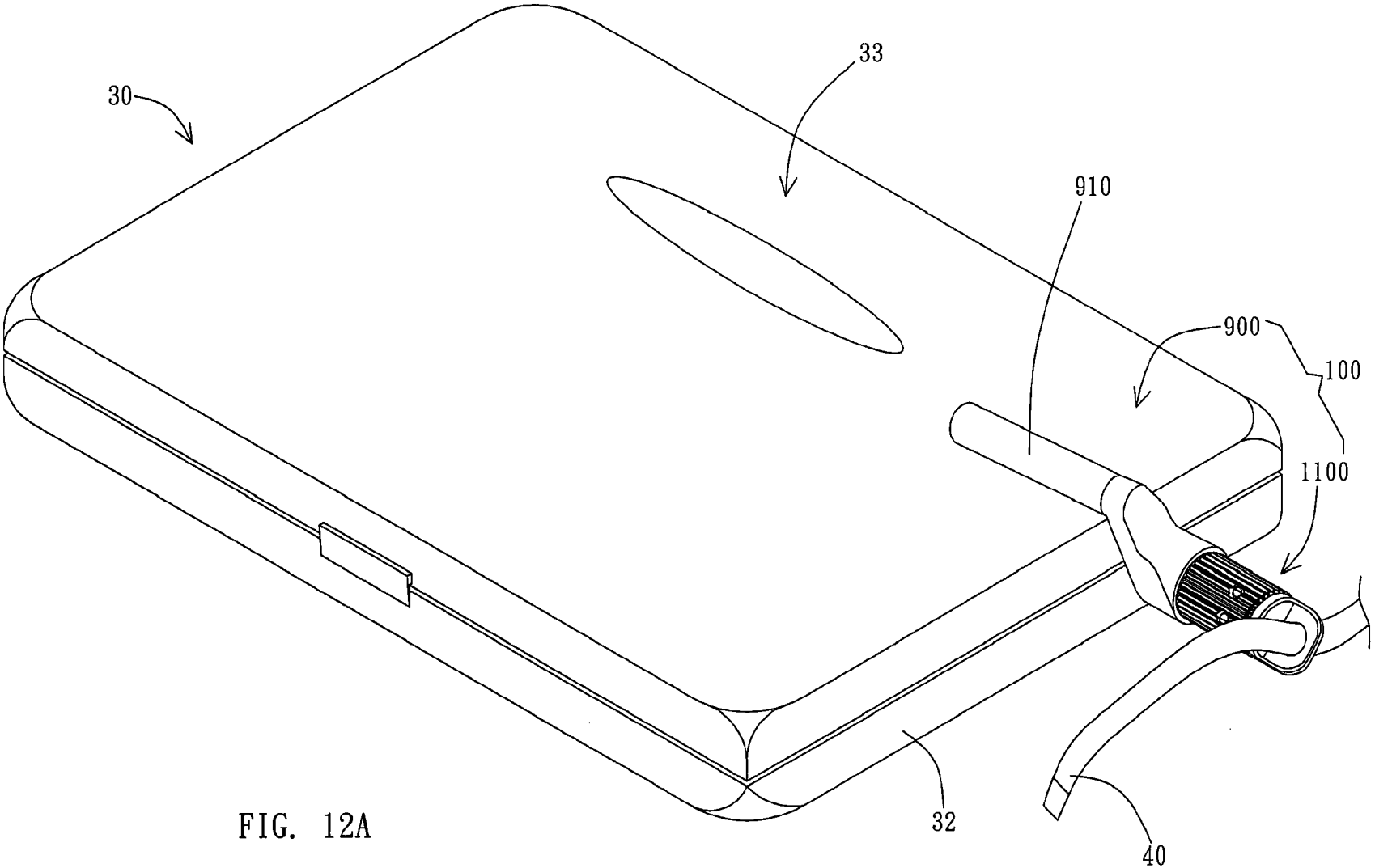
FIG. 12A and FIG. 12B are perspective views illustrating the anti-theft device of the second embodiment of the present invention which is fastened to a folded laptop computer, wherein a localizer is used to lock the laptop computer to an immovable object.
Figure 12B:
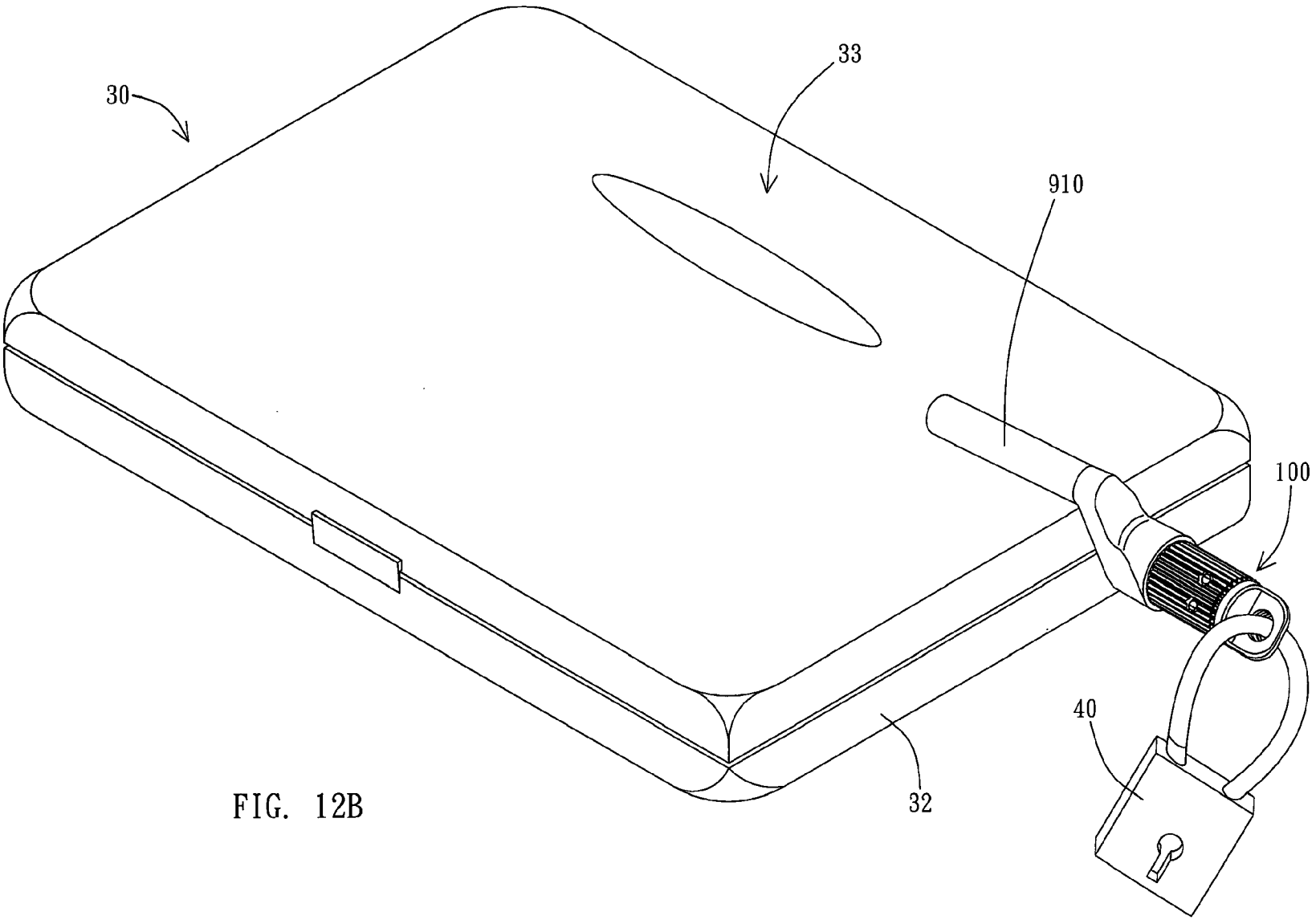

FIG. 12A and FIG. 12B are perspective views of the anti-theft device 100 of the first embodiment of the present invention which is fastened to a folded laptop computer 30. The engaging/disengaging device 1100 engages with the security aperture 200 (not illustrated) formed on the housing 32 of the laptop computer 30. The leg 910 of the coupler 900, on the other hand, is horizontally attached to or disposed over the hinged member 32 of the laptop computer 30. As shown in FIG. 12A and FIG. 12B, a localizer 40 in a form of a cable lock system or a padlock is used to lock the anti-theft device 100 to an immovable object such as a leg or a surface of a table (not illustrated). Thus the localizer 40 limits the portability of the laptop computer 30. However, in the present embodiment, the localizer 40 also prevents the anti-theft device 100 from being removed and thus maintains the laptop computer 30 in a folded configuration. It can be seen that the anti-theft device 100 prevents the folded laptop computer 30 from being opened. The folded laptop computer 30 can only be released when the anti-theft device 100 is disengaged. As explained in the previous paragraphs, even when the coupling disc 500 is adapted, the coupler 900 is preferably designed to be rotatably in only one direction. Thus the coupler 900 cannot be further rotated once the leg 910 of the coupler 900 has horizontally touched against the hinged member 32 of the laptop computer 30. The engaging/disengaging device 1100 has to be removed before the coupler 900 can be removed, and thus the folded laptop computer 30 can be released.

It is to be noted that the anti-theft device 100 of the present invention described in the entire specification is preferably made of rigid material which can withstand possible vicious damages from potential thieves of the portable electronic device. The rigid material may include metal, plastic, or other materials.

The foregoing descriptions of the particular embodiments of the invention are not intended to limit the invention to the embodiment described. It is recognized that modifications within the scope of the invention will occur in light of the above descriptions. Such modifications and equivalents of the invention are intended for inclusion within the scope of this invention. The embodiments were chosen and described in order to best explain the principles of the present invention and its practical application.

What is claimed is:

1. An anti-theft device for a portable device, wherein the portable device includes an aperture, the anti-theft device comprising:

a coupler, including:

a bridge portion including a through hole, wherein a plurality of indentations are distributed around the through hole, the through hole corresponds to the aperture of the portable device; and a leg extending from the bridge portion;

an engaging/disengaging device including an engaging mechanism, wherein the engaging mechanism passes through the through hole of the coupler to mechanically engage with the aperture and to position the leg and the bridge portion of the coupler on two adjacent sides of the portable device; and a localizer for coupling the engaging/disengaging device with an immovable object, wherein the localizer limits the engaging/disengaging device to be mechanically engaged with the aperture.

2. The anti-theft device of claim 1, wherein the leg of the coupler has an elongated flat shape or a cylindrical shape.

3. The anti-theft device of claim 1, wherein the engaging/disengaging device has a plurality of matching indentations corresponding to the indentations of the coupler, so that the engaging/disengaging device is fitted into the through hole of the coupler.

4. The anti-theft device of claim 1, wherein the engaging/disengaging device includes a localizer aperture on a side opposite to the engaging mechanism for the localizer to pass through.

5. The anti-theft device of claim 1, wherein the aperture of the portable device includes a security aperture, a threaded aperture, or a USB receptacle, the engaging mechanism has a structure including a hook, a screw, or a USB connector with respect to the aperture of the portable device.

6. The anti-theft device of claim 5, wherein when the aperture of the portable device includes the threaded aperture, the engaging mechanism includes the screw rotatably driven to be engaged with or disengaged from the threaded aperture of the portable device.

7. The anti-theft device of claim 6, wherein the engaging mechanism includes a rotary member for rotatably driving the screw.

8. The anti-theft device of claim 1, wherein the engaging/disengaging device includes a push-pull switch and a casing, a part of the push-pull switch is disposed to selectively be pushed toward the casing to position the engaging mechanism into an engaging position and be pulled away from the casing to position the engaging mechanism into a disengaging position.

9. The anti-theft device of claim 8, wherein the push-pull switch and the casing each has at least a localizer aperture, when the push-pull switch is pushed toward the casing, the localizer aperture of the casing and the localizer aperture of the push-pull switch are aligned to allow the localizer to pass through to position the engaging mechanism into the engaging position.

10. The anti-theft device of claim 8, wherein the engaging/disengaging device includes a combination lock for fixing the position of the push-pull switch.

11. The anti-theft device of claim 1, wherein the localizer includes a cable lock system, a padlock, or a combination thereof.

12. The anti-theft device of claim 1, further comprising a coupling disc for coupling the coupler with the engaging/disengaging device.

13. The anti-theft device of claim 12, wherein the coupler is rotatably coupled with the coupling disc so that the leg of the coupler is rotatably moved to restrain the portable device in a folded configuration.

14. The anti-theft device of claim 13, wherein the coupling disc includes an insertion aperture and at least one wedging member disposed on a side of the coupling disc, the insertion aperture corresponds to the through hole of the coupler, the wedging member is wedged into the through hole so that the engaging mechanism passes through the insertion aperture and the through hole to mechanically engage with the aperture of the portable device.

15. The anti-theft device of claim 14, wherein the at least one wedging member is flexibly disposed around the insertion aperture.

16. The anti-theft device of claim 14, the wedging member includes a convex extending away from a centre axis of the coupling disc, the convex contacts one of the indentations in the through hole when the wedging member is wedged into the through hole.

17. The anti-theft device of claim 16, wherein when the coupler rotates with respect to the coupling disc, the indentation of the coupler pushes the convex toward a centre axis of the coupling disc by bending a part of the wedging member.

18. The anti-theft device of claim 17, wherein the convex moves from the one indentation to a different indentation to position the leg at a desired position so that the portable device is restrained to the folded configuration.

19. The anti-theft device of claim 1, wherein the localizer includes a cable, a padlock, a combination lock, and a combination thereof.

* * * * *